United States Patent [19]

Dugan

[11] Patent Number: 4,889,243

[45] Date of Patent: Dec. 26, 1989

[54] APPARATUS FOR DETECTING AND EJECTING BENT CROWNS

[75] Inventor: Larry M. Dugan, Boulder, Colo.

[73] Assignee: Adolph Coors Company, Golden, Colo.

[21] Appl. No.: 205,934

[22] Filed: Jun. 13, 1988

[51] Int. Cl.[4] ..... B07C 5/06

[52] U.S. Cl. ..... 209/626; 209/655; 209/657; 209/928

[58] Field of Search ..... 209/540–545, 209/600, 601, 604, 625, 626, 627, 598, 655, 657, 928, 629, 656

[56] References Cited

U.S. PATENT DOCUMENTS

| | | | |
|---|---|---|---|
| 3,310,142 | 3/1967 | Hausen et al. | 209/928 X |
| 3,400,815 | 9/1968 | Bell et al. . | |
| 3,537,579 | 11/1970 | Roberson | 209/625 X |
| 3,625,357 | 12/1971 | Ochs et al. | 209/625 |
| 3,669,261 | 6/1972 | Moulin | 209/657 X |
| 3,737,033 | 6/1973 | Toth et al. | 209/626 X |
| 3,743,093 | 7/1973 | Klancnik | 209/601 X |
| 3,746,163 | 7/1973 | Ochs et al. | 209/625 X |
| 3,869,042 | 3/1975 | Floyd et al. . | |
| 4,089,420 | 5/1978 | Sundman . | |
| 4,146,467 | 3/1979 | Sauer et al. . | |
| 4,161,251 | 7/1979 | Paul | 209/626 X |
| 4,171,262 | 10/1979 | Lattmann et al. | 209/657 X |
| 4,402,412 | 9/1983 | Wood | 209/625 |
| 4,560,060 | 12/1985 | Lenhart . | |

*Primary Examiner*—Margaret A. Focarino
*Assistant Examiner*—Edward M. Wacyra
*Attorney, Agent, or Firm*—Klaas & Law

[57] ABSTRACT

A conveying system for crowns used to cap containers having a portion thereof adapted to detect and eject bent crowns comprising a conveyor chute for permitting the gravity feed of bent and unbent crowns therethrough, a conventional crown orienting apparatus for orienting each crown to be in the same relationship and a transfer system between the conveyor chute and the crown orienting apparatus for transferring crowns between the conveyor chute and the crown orienting apparatus and wherein the transfer system has a movable bent crown detecting apparatus for stopping the movement of bent crowns therethrough but permitting the movement of unbent crowns therethrough. A sensing device that is responsive to the stoppage of flow of the crowns through the bent crown detecting apparatus is provided and functions to signal appropriate apparatus to stop the flow of crowns into the transfer system, to move the detecting apparatus so that the bent crown may move therethrough and to activate a bent crown ejecting apparatus to remove the bent crown from the transfer system and to return the conveying system to normal operations.

19 Claims, 2 Drawing Sheets

12
8
14
6
14
12
10
16b
16a
14
12
8
52
50
52
4
110
118
112
130
42
132
46
24
134
30
44
48
136
140
22
60
58
60
26
56
146
60
58
20
2
148

18a
8
10
6
8
18b
4
3
3
90
94
30
4
4
92
5
5
24
136
104
74
76
22
140
96
80
98
100
82
78
26
6
6
60
60
70
72
66
68
102
56
60
60
20
144
142
2

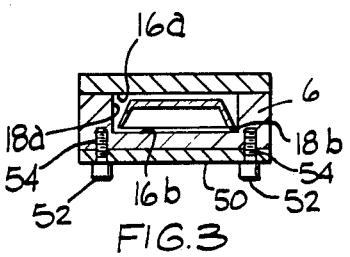
FIG.3
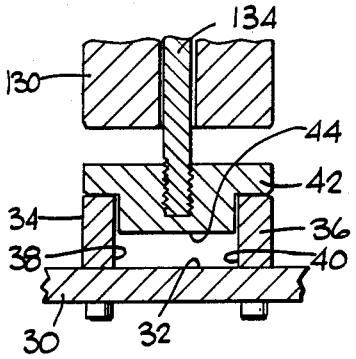
FIG.5
FIG 4
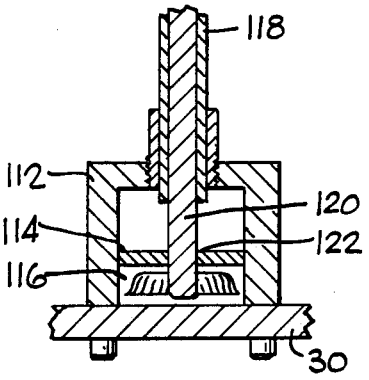
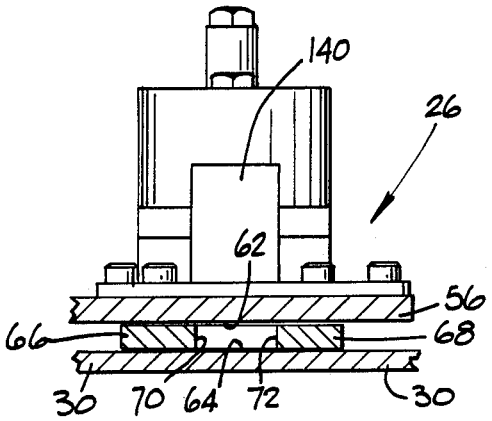
FIG.6

APPARATUS FOR DETECTING AND EJECTING BENT CROWNS

FIELD OF THE INVENTION

This invention relates generally to the manufacturing process relating to the filling of containers with beverages and more particularly to a conveying system for feeding crowns to an applicator which applies the crowns to the containers.

BACKGROUND OF THE INVENTION

In a conventional manufacturing process relating to the filling of containers with beverages which containers are then capped with crowns, it is conventional to dump large quantities of crowns into a hopper which is provided with apparatus to feed the crowns successively into a gravity feed conveyor chute. To facilitate production requirements, this gravity feed conveyor chute has a rectangular cross-sectional figuration small enough to orient the crowns so that the upper surfaces of the crowns face in one of two opposite directions but large enough to permit the passage therethrough of the crowns. The conveyor chute has a discharge end which feeds the crowns into a crown orienting apparatus which acts on the crowns to ensure that each crown to be fed to the container capping apparatus leaves the crown orienting apparatus with the upper surface thereof facing in the same direction. If a bent crown enters the crown orienting apparatus, it may become stuck therein so as to stop the flow of crowns to the container capping apparatus. When this occurs, it is necessary to stop the feeding of crowns to the conveyor chute and open an emergency door on the crowning orienting apparatus in order to remove the bent crown.

BRIEF DESCRIPTION OF THE INVENTION

This invention provides a conveying system for crowns used to cap containers wherein a transfer system is located between a gravity feed conveyor means through which bent and unbent crowns pass and a crown orienting apparatus and which transfer system is provided with bent crown detecting means and bent crown ejecting means so that a bent crown in the conveying system may be detected and ejected with no significant stoppage of the flow of crowns through the conveying system and to the container capping apparatus.

In the preferred embodiment of the invention, there is provided a conveying system for receiving crowns from a feed hopper and conveying the crowns successively through conveyor means, a transfer system and a crown orienting apparatus. The conveying system includes conveyor means for permitting the gravity feed therethrough of a plurality of crowns in successive order, each of the crowns having an upper surface and a lower edge and which conveyor means has a cross-sectional configuration formed by a first pair of fixed opposite wall members having generally planar facing surfaces which are parallel to each other and a second pair of fixed opposite wall members having generally planar facing surfaces which are parallel to each other, which cross-sectional configuration permits passage therethrough of bent and unbent crowns. The crowns and the first and second pairs of opposite wall members are dimensioned so that the crowns pass through the conveyor system with the upper surfaces of the crowns generally parallel and facing one or the other of the facing surfaces of the first pair of opposite wall members. Crown orienting apparatus is provided for receiving crowns that have passed through the conveyor system and orienting the crowns so that the upper surfaces thereof face in the same direction. The conveyor means has a downstream end spaced from an upstream end of the crown orienting apparatus. A transfer system is located between the downstream end and the upstream end for permitting movement of the crowns therethrough so as to transfer the crowns between the conveyor means and the crown orienting apparatus. Bent crown detecting means are provided in the transfer system for detecting the presence of a bent crown and include movable stopping means for movement in response to a signal between a first position to stop the movement of a bent crown through the bent crown detecting means or to a second position to permit the movement of a bent crown through the bent crown detecting system to a bent crown ejecting means. The bent crown ejecting means are located in the transfer system and are movable, in response to a signal, between a first position for permitting movement of the unbent crowns through the movable bent crown ejection means to the crown orienting apparatus and a second position for ejecting a bent crown from the transfer system so that the bent crown will not be transferred to the crown orienting apparatus.

BRIEF DESCRIPTION OF THE DRAWINGS

An illustrative and presently preferred embodiment of the invention is shown in the accompanying drawings in which:

FIG. 3 is a cross-sectional view taken on the line 3—3 of FIG. 2;

FIG. 4 is a cross-sectional view taken on the line 4—4 of FIG. 2;

FIG. 5 is a cross-sectional view taken on the line 5—5 of FIG. 2; and FIG. 6 is a cross-sectional view taken on the line 6—6 of FIG. 2.

DETAILED DESCRIPTION OF THE INVENTION

Figure 1:
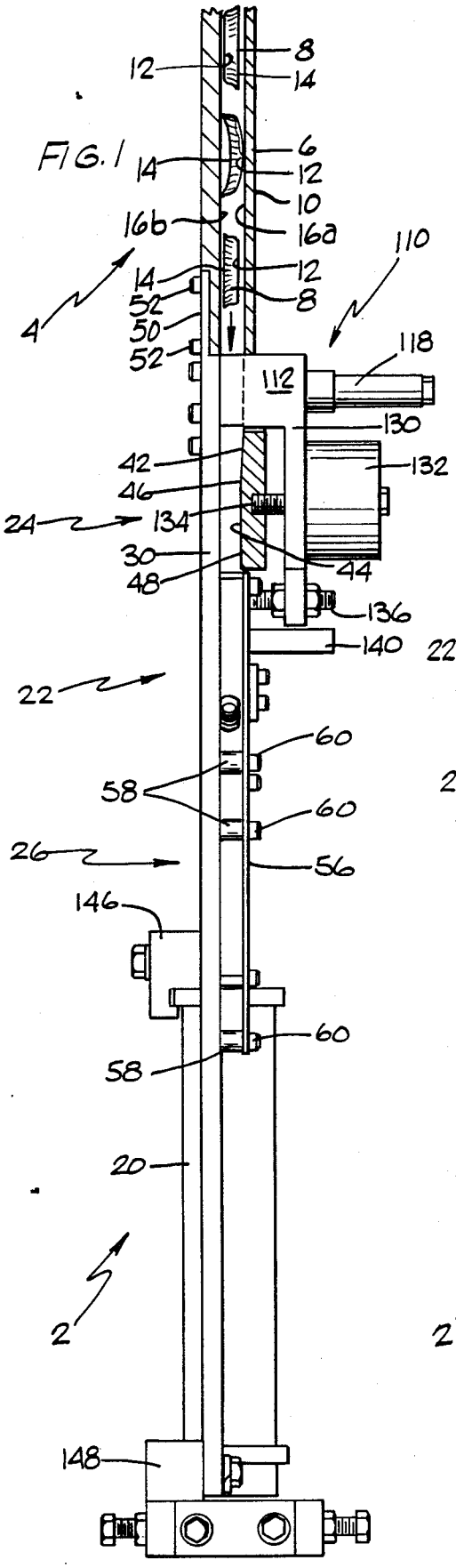
FIG. 1 is a side elevational view with parts in section of the preferred embodiment of the invention.
Figure 2:
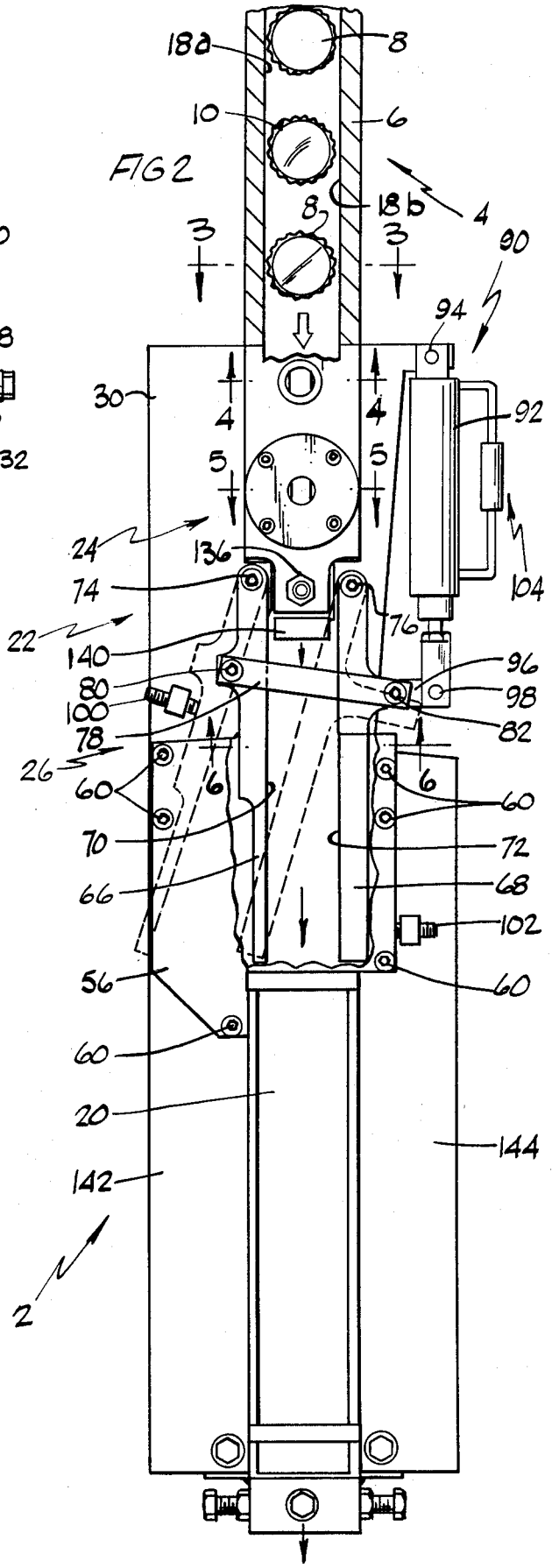
FIG. 2 is a front elevational view of FIG. 1.

A conveying system 2 of this invention is illustrated in FIGS. 1 and 2 and includes conveyor means 4 connected to a crown feeding mechanism (not shown) comprising a rectangular chute 6 through which a plurality of unbent crowns 8 and bent crowns 10 pass. The unbent crowns 8 and bent crowns 10 have an upper surface 12 and a lower edge 14. The rectangular chute 6 has a first pair of fixed wall members having opposite generally planar facing surfaces 16*a* and *b* in parallel relationship and a second pair of fixed opposite wall members having generally planar facing surfaces 18*a* and *b* in parallel relationship. The unbent crowns 8 and bent crowns 10 pass through the rectangular duct 6 with the upper surfaces 12 thereof facing either of the generally planar surfaces 16*a* or 16*b*. The conveying system 2 also includes a second conveyor means feeding unbent crowns to a conventional crown orienting apparatus 20 which functions to orient the unbent crowns 8 so that the upper surfaces 12 thereof face in the same direction such as the type marketed by H & K under the trade designation crown sorter VVF 100-32. A transfer system 22 is located between the downstream end of the rectangular duct 6 and the upstream end of the second conveyor means feeding unbent crowns to the crown orienting apparatus 20. The transfer system 22 includes a bent crown detecting means 24 and a movable bent crown ejecting means 26.

The bent crown detecting means 24, as illustrated in FIGS. 1 and 5, comprises a fixed base member 30 having a fixed generally planar surface 32 which lies generally in the same plane as planar surface 16*b*. A pair of fixed side plates 34 and 36 have facing generally planar surfaces 38 and 40 which lie in the same planes as planar surfaces 18*a* and 18*b*. A movable member 42 has a surface 44 facing the planar surface 32 which surface 44 has at least two different portions 46 and 48 which are spaced at different distances from the planar surface 32. When the movable member 42 is in a first closed position, as illustrated in FIG. 1, the rectangular cross-sectional configuration formed by the planar surfaces 32, 38 and 40 and the portion 46 is substantially the same as the cross-sectional configuration formed by the generally planar surfaces 16*a* and 16*b* and 18*a* and 18*b* so that unbent crowns 8 and bent crowns 10 can pass therethrough. However, the cross-sectional configuration formed by the planar surfaces 32, 38 and 40 and the portion 48 is smaller than the cross-sectional configuration formed by the planar surfaces 32, 38 and 40 and the portion 46 so that only unbent crowns 8 will pass therethrough while bent crowns 10 will become stuck therein. When the movable member 42 is moved to a second opened position, the cross-sectional configuration formed by the planar surfaces 32, 38 and 40 and the portion 48 is at least as large as the cross-sectional configuration formed by the planar surfaces 16*a* and 16*b* and 18*a* and 18*b* so that unbent crowns 8 and bent crowns 10 can pass therethrough. An extension 50 of the base member 30 is secured to the rectangular chute 6 by threaded bolts 52 in threaded openings 54.

The bent crown ejecting means 26, illustrated in FIGS. 2 and 6, comprises a first pair of opposite wall members comprising a plate member 56 secured to the base member 30 in spaced relationship thereto by a plurality of block support members 58 and bolts 60 in threaded openings in the base member 30 so as to form generally planar facing surfaces 62 and 64 lying in the same plane as generally planar surfaces 16*a* and 16*b*. A second pair of opposite wall members 66 and 68 have generally planar facing surfaces 70 and 72 which are in parallel relationship. The second pair of opposite wall members 66 and 68 are pivotally mounted on pivot pins 74 and 76 secured on the base member 30. A cross-member 78 is pivotally mounted on the wall members 66 and 68 by pivot pins 80 and 82 so that when the wall members 66 and 68 are rotated around the pivot pins 74 and 76, the generally planar facing surfaces 70 and 72 will remain in the parallel relationship. The cross-sectional configuration formed by the generally planar facing surfaces 62, 64, 70 and 72 permits the passage therethrough of unbent crowns 8 and bent crowns 10. When the second pair of wall members 66 and 68 are in a first position, indicated by the solid lines in FIG. 2, the generally planar facing surfaces 70 and 72 lie in the same plane as the generally planar facing surfaces 18*a* and 18*b* so that unbent crowns may pass therethrough into the second conveyor means feeding unbent crowns to crown orienting apparatus 20. When the second pair of wall members are in a second position, indicated by the dashed lines in FIG. 2, the generally planar facing surfaces 70 and 72 are inclined relative to the generally planar facing surfaces 18*a* and 18*b* so that bent crowns 10 passing therethrough will be ejected from the conveying system 2.

Force applying means 90 are provided for rotating the second pair of wall members 66 and 68 around the pivot pins 74 and 76 and comprises an air cylinder 92 pivotally connected to the base member 30 by pivot pin 94. The air cylinder 92 is also pivotally connected to an integral lug 96 on the wall member 68 by pivot pin 98. Adjustable stop means 100 are provided to limit the movement of the second pair of wall members 66 and 68 at the second position to eject a bent crown 10 from the conveying system 2. Adjustable stop means 102 are provided to limit the movement of the second pair of wall members 66 and 68 so that unbent crowns 8 may pass therethrough to the crown orienting apparatus 20. Means 104 are provided to move the piston of the air cylinder.

The transfer system 22 also has movable movement preventing means 110, illustrated in FIGS. 1 and 4, comprising a housing 112 secured to the base member 30 and having a cross member 114 so as to form a passageway 116 therein so that unbent crowns 8 and bent crowns 10 may pass therethrough. An air cylinder 118 is mounted on the housing 112 and has a movable rod member 120 which passes through an opening 122 in the cross-member 114. The rod member 120 is moved by the air cylinder 118 in response to a signal between a first opened position to permit the movement of unbent and bent crowns 8 and 10 through the passageway 116 and a second closed position, illustrated in FIG. 4, to prevent the movement of unbent or bent crowns 8 and 10 through the passageway 114. A support member 130 extends outwardly from the housing 112 and has an air cylinder 132 mounted thereon which air cylinder 132 has a movable shaft 134, FIG. 5, which has the movable member 42 of the bent crown detecting means 24 secured thereto. An adjusting screw 136 is secured to the support member 130 and bears against the plate member 56 so that the distance between the planar surface 32 and the different portions 46 and 48 may be adjusted.

A sensing device 140, such as a conventional fiber optic sensor, is mounted on the plate member 56 so that it can detect the movement of unbent crowns 8 through the passageway formed by the planar surfaces 62, 64, 70 and 72. If a bent crown is stopped by the portion 48, no crowns will pass through the passageway. The sensing device 140 will respond to the absence of the crowns and generate a signal to operate the various devices as described below.

The base member 30 has bifurcated portions 142 and 144 for securing the base member 30 to the crown orienting apparatus 20 by the block members 146 and 148.

In operation under normal conditions, that is no bent crowns being moved through the conveying system 2, the movable movement preventing means 110, the bent crown detecting means 24 and the movable bent crown ejecting means 26 are all in the first position. When a bent crown 10 enters the transfer system 22, it is stopped by the bent crown detecting means 24 so that the flow of crowns past the sensing device 140 is stopped. The sensing device 140 recognizes the stoppage and transmits a signal to a conventional computer (not shown) which is programmed to send signals to the air cylinders 118, 132 and 92. The air cylinder 118 responds to the signal to move the rod 120 to the second position in the passageway 114 to stop the flow of crowns into the transfer system 22. Substantially simultaneously, a signal is sent to the air cylinder 132 to move the shaft 134 and the movable member 42 away from the planar surface 32 to the second position to free the stopped bent crown 10 so that it may move into the movable bent crown ejecting means 26. At the same time, a signal is sent to the air cylinder 92, to rotate the second pair of wall members 66 and 68 to the second position so that the bent crown 10 moving through the bent crown ejecting means 26 will be ejected from the conveying system 2. The programmed computer sends signals to the air cylinders 110, 132 and 92 to return the movable movement preventing means 110, the bent crown detecting means 24 and the bent crown ejecting means 26 to the first position after a desired time interval, such as 2 seconds.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A conveying system for crowns used to cap containers having a portion thereof adapted to detect and eject bent crowns comprising:

first conveyor means for permitting the passage therethrough of a plurality of crowns in successive order, each of said crowns having an upper surface and a lower edge;

said first conveyor means having a cross-sectional configuration formed by a first pair of fixed opposite wall members having generally planar facing surfaces which are parallel to each other and a second pair of fixed opposite wall members having generally planar facing surfaces which are parallel to each other, said cross-sectional configuration permitting passage therethrough of bent and unbent crowns;

said crowns and said first and second pairs of opposite wall members being dimensioned so that said crowns pass through said first conveyor means with said upper surfaces of said crowns generally parallel to said facing surfaces of said first pair of opposite wall members;

second conveyor means having an upstream end for receiving unbent crowns passing through said conveying system and for permitting the passage therethrough of a plurality of unbent crowns in successive order;

said first conveyor means having a downstream end spaced from said upstream end of said second conveyor means;

a transfer system located between said downstream end and said upstream end and having a passageway extending therethrough for permitting movement of said crowns therethrough so as to enable transfer of said crowns between said first conveyor means and said second conveyor means;

bent crown detecting means comprising a part of said transfer system for detecting the presence of a bent crown;

movable bent crown ejecting means located downstream from said bent crown detecting means comprising a part of said transfer system for movement, in response to a signal, between a first position permitting movement of said crowns through said movable bent crown ejection means to said second conveyor means and a second position for ejecting a bent crown from said transfer system so that said bent crown will not be transferred to said second conveyor means;

said movable bent crown ejecting means normally being in said first position;

said bent crown detecting means having movable stopping means for movement, in response to a signal, between a first position stopping the movement of a bent crown through said bent crown detecting means and a second position permitting movement of said bent crown through said bent crown detecting means to said movable bent crown ejecting means; and said movable stopping means normally being in said first position.

2. The invention as in claim 1 and further comprising:

movable movement preventing means for movement, in response to a signal, between a first position permitting the movement of said crowns into said passageway in said transfer system and a second position preventing the movement of said crowns into said passageway of said transfer system; and said movable movement preventing means normally being in said first position.

3. The invention as in claim 2 and further comprising:

signal generating means for detecting the stopping of movement of said crowns past said bent crown detecting means and generating said signal to move said movable movement preventing means to said second position for preventing movement of said crowns into said passageway of said transfer system.

4. The invention as in claim 3 wherein:

said signal generating means generating said signal to move said movable stopping means to said second position for permitting movement of said bent crown through said bent crown detecting means and into said movable crown ejecting means.

5. The invention as in claim 4 wherein:

said signal generating means generating said signal to move said movable bent crown ejecting means to said second position for ejecting said bent crown from said transfer system.

6. The invention as defined in claim 1 wherein said movable stopping means comprises:

a first pair of opposite wall members comprising a fixed wall member and a movable wall member;

said fixed wall member having a planar surface substantially coplanar with one of said facing surfaces of said first pair of fixed opposite wall members of said first conveyor means;

said movable wall member having a surface facing said planar surface of said fixed wall member and having portions thereof spaced at different distances from said planar surface of said fixed wall member;

a second pair of fixed opposite wall members having generally planar facing surfaces which are substantially coplanar with said facing surfaces of said second pair of opposite wall members of said first conveyor means;

said movable stopping means, when said movable wall member is in said first position to stop the movement of a bent crown therethrough, having a first cross-sectional configuration in the direction of movement of said crowns which is substantially the same as said cross-sectional configuration of said first conveyor means and at least a second cross-sectional configuration which is smaller than said cross-sectional configuration of said first conveyor means; and said second cross-sectional configuration permitting movement of said unbent crowns therethrough but stopping the movement of said bent crowns therethrough.

7. The invention as in claim 6 wherein:

said second cross-sectional configuration, when said movable wall member is in said second position to permit movement of a bent crown therethrough, being at least substantially the same as said cross-sectional configuration of said first conveyor means to permit passage of bent and unbent crowns therethrough.

8. The invention as in claim 7 and further comprising:

movable movement preventing means for movement, in response to a signal, between a first position permitting the movement of said crowns into said passageway of said transfer system and a second position preventing the movement of said crowns into said passageway of said transfer system, and said movable movement preventing means normally being in said first position.

9. The invention as in claim 8 wherein said movable movement preventing means comprises:

a housing having at least one opening formed therein mounted on said transfer system so that said at least one opening is in communication with said passageway of said transfer system; and a movable rod member mounted for reciprocal movement in said housing between said first position permitting passage of said crowns into said passageway of said transfer system and a second position wherein a portion of said movable rod member has passed through said at least one opening into said passageway so as to prevent passage of said crowns past said portion of said movable rod means.

10. The invention as in claim 1 wherein said movable bent crown ejecting means comprises:

a first pair of fixed opposite wall members having facing generally planar surfaces which are coplanar with said facing surfaces of said first pair of fixed opposite wall members of said first conveyor means;

a second pair of opposite wall members having generally planar facing surfaces which are parallel to each other so that said movable crown ejecting means has a cross-sectional configuration substantially the same as said cross-sectional configuration of said first conveyor means; and mounting means for pivotally mounting said second pair of opposite wall members to permit movement thereof between a first position wherein said facing generally planar surfaces thereof are coplanar with said generally planar facing surfaces of said second pair of fixed opposite wall members of said first conveyor means so that unbent crowns may pass therethrough and a second position wherein said facing generally planar surfaces thereof extend at an angle to said generally planar facing surfaces of said second pair of fixed opposite wall members of said first conveyor means so that bent crowns passing therethrough will be ejected from said transfer system; and said second pair of opposite wall members normally being in said first position.

11. The invention as in claim 10 and further comprising:

a member extending between and pivotally connected to said second pair of opposite wall members to ensure that said generally planar facing surfaces remain parallel to each other during said pivotal movement thereof.

12. The invention as in claim 11 and further comprising:

force applying means for applying a force to at least one of said second pair of opposite wall members to cause said pivotal movement thereof.

13. The invention as in claim 12 and further comprising:

first stop means for stopping said pivotal movement so that said second pair of opposite wall members are located in said first position; and second stop means for stopping said pivotal movement so that said second pair of opposite wall members are located in said second position.

14. The invention as in claim 13 wherein said force applying means comprises:

an air cylinder having a piston slidably mounted therein;

pivot means for pivotally mounting said air cylinder on said base member;

pivot means for pivotally mounting said piston to said at least one of said second pair of opposite wall members; and force applying means for moving said piston in reciprocal directions in said air cylinder.

15. The invention as in claim 12 and further comprising:

a sensing device for detecting the stopping of movement of said crowns past said bent crown detecting means and generating said signal to move said movable movement preventing means to said second position for preventing movement of said crowns into said passageway of said transfer system, to move said movable stopping means to said second position for permitting movement of said bent crown through said bent crown detecting means and into said movable crown ejecting means and to move said movable bent crown ejecting means to said second position for ejecting said bent crown from said transfer system.

16. The invention as in claim 10 wherein said movable stopping means comprises:

a first pair of opposite wall members comprising a fixed wall member and a movable wall member;

said fixed wall member having a planar surface substantially coplanar with one of said facing surfaces of said first pair of fixed opposite wall members of said first conveyor means;

said movable wall member having a surface facing said planar surface of said fixed wall member and having portions thereof spaced at different distances from said planar surface of said fixed wall member;

a second pair of fixed opposite wall members having generally planar facing surfaces which are substantially coplanar with said facing surfaces of said second pair of opposite wall members of said first conveyor means;

said movable stopping means, when said movable wall member is in said first position to stop the movement of a bent crown therethrough, having a first cross-sectional configuration in the direction of movement of said crowns which is substantially the same as said cross-sectional configuration of said first conveyor means and at least a second cross-sectional configuration which is smaller than said cross-sectional configuration of said first conveyor means; and said second cross-sectional configuration permitting movement of said unbent crowns therethrough but stopping the movement of said bent crowns therethrough.

17. The invention as in claim 16 wherein:

said second cross-sectional configuration, when said movable wall member is in said second position to permit movement of a bent crown therethrough, being at least substantially the same as said cross-sectional configuration of said first conveyor means to permit passage of bent and unbent crowns therethrough.

18. The invention as in claim 17 and further comprising:

movable movement preventing means for movement, in response to a signal, between a first position permitting the movement of said crowns into said passageway of said transfer system and a second position preventing the movement of said crowns into said passageway of said transfer systems; and said movable movement preventing means normally being in said first position.

19. The invention as in claim 18 wherein said movable movement preventing means comprises:

a housing having at least one opening formed therein mounted on said transfer system so that said at least one opening is in communication with said passageway of said transfer system; and a movable rod member mounted for reciprocal movement in said housing between said first position permitting passage of said crowns into said passageway of said transfer system and a second position wherein a portion of said movable rod member has passed through said at least one opening into said passageway so as to prevent passage of said crowns past said portion of said movable rod means.

* * * * *